United States Patent [19]

Mészaros et al.

[11] 3,982,736

[45] Sept. 28, 1976

[54] INTENSIFICATION OF FLUID-FLUID TRANSPORT PROCESSES

[75] Inventors: Lajos Mészaros, Szeged; József Grega, Miskolc; Lajos Lako, Miskolc; László Marko, Miskolc; Zoltán Salamon; István Szatmari, both of Sajobabony; Laszlo Tasi, Miskolc, all of Hungary

[73] Assignee: Eszakmagyarorszagi Vegyimuvek, Sajobabony, Hungary

[22] Filed: May 20, 1974

[21] Appl. No.: 471,821

[52] U.S. Cl. ..... 259/107

[51] Int. Cl.[2] ..... B01F 7/20

[58] Field of Search ..... 259/1 R, DIG. 46, 99, 259/106, 107, 108, 109, 110

[56] References Cited

UNITED STATES PATENTS

| | | | |
|---|---|---|---|
| 2,958,517 | 11/1960 | Harker | 259/DIG. 46 |
| 3,140,079 | 7/1964 | Baermann | 259/108 |
| 3,219,318 | 11/1965 | Hershler | 259/DIG. 46 |

*Primary Examiner*—Edward L. Roberts
*Assistant Examiner*—Alan Cantor
*Attorney, Agent, or Firm*—Young & Thompson

[57] ABSTRACT

Transport processes such as emulsification, mass transfer, dissolution, washing or chemical reaction are carried out by admixing two substantially immiscible fluid phases with a rotary agitator having thereon filamentary elements that occupy 0.1% to 20% of the space to be swept thereby, whose thickness is 10–5000 μm and whose thickness-to-length ratio is 1:5 to 1:5000, there being several thousand such elements on the rotor, that rotates at several thousand rpm, the elements having peripheral speed of at least 30 m/s.—The operation is improved by also including in the fluid medium solid particles of a size 1–1000 μm.

3 Claims, 7 Drawing Figures

INTENSIFICATION OF FLUID-FLUID TRANSPORT PROCESSES

The invention relates to the intensification of transport processes by which heterogeneous chemical reactions can be carried out in a continuous operation.

In everyday industrial practice, transport processes such as impulse transport, component transport and heat transport are of importance, and the physical and chemical operations are realized through such processes. A great number of technical solutions and types of equipments have been developed for carrying out transport processes. Transport processes take place when substances are dispersed, when suspensions, emulsions or foams are produced or sprayed, when substances are extracted or a gas is allowed to be absorbed by a liquid or when substances are coagulated in order to suspend the dispersed state of the system etc.

On carrying out homogeneous and particularly heterogeneous chemical reactions all types of the transport processes take place though the transport of components and heat plays an essentially important role.

In industrial practice, stirring is a frequent and widespread operation that realizes actual transport processes by means of stirrers and devices equipped with stirrers. The operation of stirring, the development of stirrers, the theory of admixture, and the apparatus suitable for solving various tasks have a very extensive literature see Gábor FEJES: Ipari keveróberendezések. (Industrial stirring equipment). Müszaki Könyvkiadó, Budapest, 1970. (in Hungarian).

All of the various types of stirrers in widespread use for the stirring of solid and liquid materials: such as two-armea kneaders, screw kneaders, epicyclickneaders colloidal mills, special ball mills, blade stirrers, impeller stirrers, anchor stirrers, stirrers in stocks, propeller stirrers, turbine stirrers, disk stirrers, MIG-type stirrers (impulse-counter-current stirrers with several velocity steps), band stirrers, modified turbine and disk stirrers (dissolvers, super-stirrers) etc. have the common geometrical main characteristic that the agitator extends to three or at least two dimensions: it has a length and a breadth, and these dimensions are significant also in relation to the dimensions of the stirring space.

It is known that in case of the blade stirrers applied already since the earliest times the shear force created at the edges of the blades is responsible for the stirring effect whereas the surface of the blade must exert a force against the resistance of the liquid, against the intrinsic friction of the medium. The propeller stirrers where in the course of the torsion the resistance of the liquid decreases against the blades, originated from a development subsequent to this recognition, namely from the twisting of the "blades" at a certain degree, with practically unchanged shearing edge lengths. This is expressed also in the fact that the efficiency uptake of propeller stirrers is lower than that of blade stirrers.

A further increase of the length of shearing edges and at the same time a relative "decrease" of blade surfaces is attained in the case of the turbine stirrers where 4 to 12 blades are fixed to one disk and eventually these blades are positioned obliquely. Although the length of the shearing edge does not increase relatively in the case of the disk stirrers having no blades, the resistance of the liquid is low due to the horizontal stirring surface, and though these stirrers can be rotated at extremely high peripheral speeds their stirring efficiency is still relatively low due to the low transport efficiency of the stirrer. In order to attain a further increase of the shearing edge the edge of the disk is "cut-in" and these cut-in portions are bent at an angle of 45° or at a smaller angle to the plane of the disk, like saw teeth. These are the so-called cogged disk stirrers or super stirrers (dissolvers).

Another common characteristic of these stirrers is that the agitator elements which are two or three-dimensional, are rigidly fixed onto the pipe end of the agitator i.e. onto the stirrer axle.

Owing to the two- or three-dimensional nature and rigid fixation of the stirrers, the increase of their speed of revolution is limited, besides the resistance of the liquid, also by their mass that is denoted for design purposes as $\mu_{crit}$, the critical angular speed, and that is inversely proportional to the square root of the mass of the stirrer.

According to the literature, stirring is weak when the peripheral speed of the stirrer is below 4 m/s, it is moderate at peripheral speeds from 4 to 7 m/s and is strong when the peripheral speed is 7–11 m/s. Other stirrer types used for the stirring of heterogeneous phases such as two-armed kneaders (e.g. the Z-stirrers), screw kneaders, epicyclic kneaders etc. are of a well-defined three-dimensional type and they are operated in general at low speeds.

Homogenizers such as colloidal mills, high-pressure homogenizers, and special ball mills disperse the phases in a way quite different from that taking place in stirrers. Still, even in these homogenizers where the liquids are forced to flow at high speeds, the agitators have well-defined surfaces (e.g. in case of the colloidal mills two conical smooth or grooved surfaces) one of which remains stable whereas the other disperses the material at a high speed. From the aspect of their efficiency the dimension of the slit is of decisive importance (it used to be between 0.01 and 3 mm).

Ball mills disperse in another way: almost 60 % of the stirring space is filled up with balls of various (0.3–3 mm) size, and these balls are moved in the medium to be dispersed by some sort of stirrer.

At the dispersion of heterogeneous phases by means of stirring the significance of the Reynolds number has long been recognized. When this number is lower than 3000 the flow is denoted as a laminar one whereas at higher values there is a turbulent flow. It is also known that it is of advantage if transport processes are carried out in the region of turbulence flow.

Besides the characteristics of the liquid, the value of the Reynolds number depends in the case of rotated stirrers on the diameter of the stirrer $d$ and the number of revolutions $n$ denoted also as peripheral speed. In order to increase the speed of transport processes the peripheral speed of the stirrer must be raised by increasing the diameter or the number of revolutions or simultaneously both parameters.

In the case of rotated stirrers (turbines, propellers) the increase of the number of revolutions is limited by the value $\mu_{crit}$ whereas according to experiments made during constructional word the most favourable ratio D:d of stirrer diameter $d$ to the diameter of the stirrer device D is generally 3 . Chemical reactions in heterogeneous phase are fundamentally affected by the dispersion of the components, i.e. of the reactants present in various phases. Reaction takes place only at the interfaces of the phases. Thus, the reactants must diffuse at first into these interfaces and after the termination of the reaction the formed products must leave these interfaces by diffusion.

Since the rate of the chemical reaction is in its strict sense essentially higher than the diffusion rate, the time requirement of this operation is determined by the diffusion and the interface. The role of the interface is of particular significance in the heterogeneous reactions where the reaction is not isothermal but is combined with the production of heat. In such cases besides a significant concentration gradient also a thermal gradient is being formed and this latter leads in the majority of cases to an undesired shift of the equilibrium of the reaction i.e. to the formation of detrimental by-products that decrease the yield.

In order to rise the rates of material transport (component transport) and of heat transport the degree of dispersion of the phases is increased, the interface is increased and the length of the path of diffusion is reduced by which measures it is attempted to decrease the time required for the operation.

It is attempted to raise the rate of the transport process and the density of the impulses, components and heat flow by their intensification.

According to the interpretation of up-to-date dynamic thermodynamics /see Dr. Pál SZOLCSÁNYI: Vegyipari müveleti egységek energetikai analizise (Energy analysis of unit operations in the chemical industry). Müszaki Könyvkiadó, Budape st, 1972, p. 296–324 (in Hungarian)/, intensification means most frequently the rate increase of a process, the rate increase of the transport of impulses, components and heat in the same volume and on the same surface, respectively.

According to the analogy of fundamental transport processes, an intensification of the transport of components and of heat is possible only at the cost of increasing the impulse transport provided the transport surface is constant.

Further possibilities of intensification are:

increase of the surface, more exactly of the specific surface per unit volume, artificial increase of the turbulence, decrease of the thickness of the border layer (more exactly the decrease of the thickness of the laminar sublayer).

Also in the case of chemical reactions in heterogeneous phase, these factors, i.e. the intensification make possible the decrease of the gradients of concentration and of heat, and until these gradients approach zero, and the operation can be carried out in a continuous way.

Continuous operation offers the advantage that equipment of smaller size is sufficient, a product of more homogeneous composition and of a consistently good quality is obtained with a smaller amount of by-products, in a more economical and more efficient way.

We found in our experiments conducted in order to intensify the transport process that intensification is attained in a qualitatively more efficient way by altering the usual geometrical dimensions of the agitator elements i.e. by applying novel agitators: point-like agitators P and line-like agitators W.

These novel agitators according to the present invention consist of point-like elements P and line-like elements W. The point-like elements P that are practically dimensionless in relation to the space to be intensified may be considered to have zero dimensions whereas the line-like elements W that extend practically in one direction (in length) in relation to the space to be intensified may be considered as one-dimensional elements.

In the accompanying drawings,

FIG. 1*a* is a somewhat schematic view of point-like agitators;

FIG. 1*b* is a somewhat schematic view of line-like agitators;

The novel agitator elements according to the present invention are shown in FIGS. 1 to 6. Owing to the limited possibilities of figure size the agitator elements could not be reproduced proportionally to the dimensions, and so the figures serve only for facilitating the understanding of the novel elements. FIG. 1*a* exhibits in general the point-like elements P of zero dimension whereas FIG. 1*b* the line-like one-dimensional elements W.

These agitators consisting of the point-like elements P of zero dimension and of the line-like one-dimensional elements W can be operated as passive or active agitators and/or in a combined way as both.

Figure 1A:
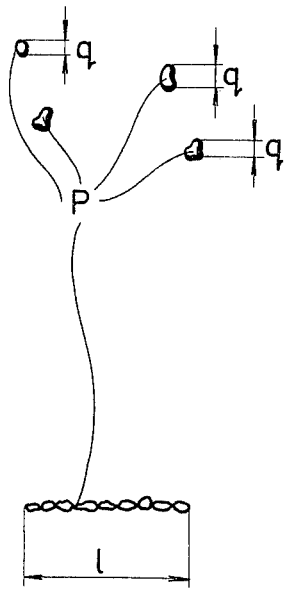
Figure 1B:
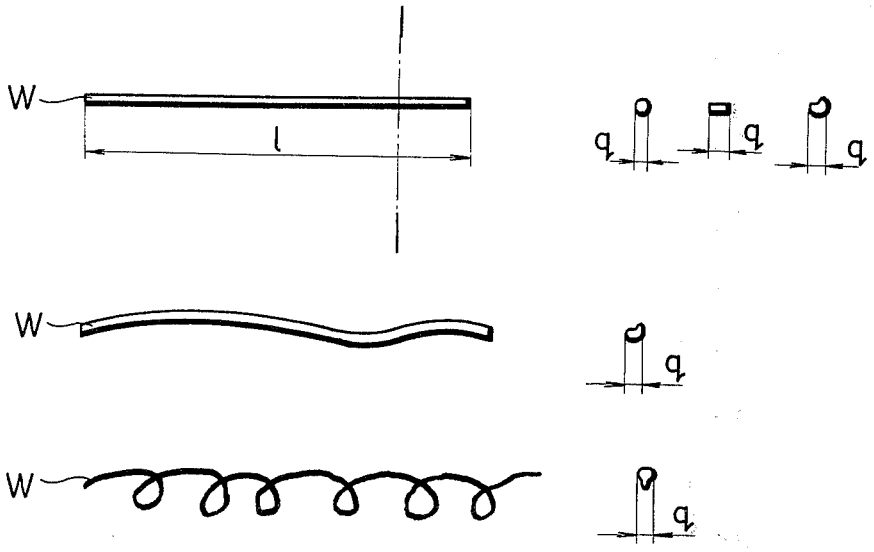
Figure 2:
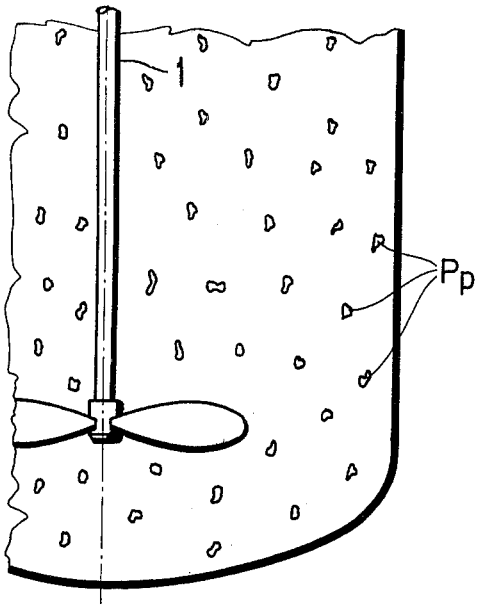
FIG. 2 is a schematic view of point-like agitators in combination with a rotor.
Figure 4:
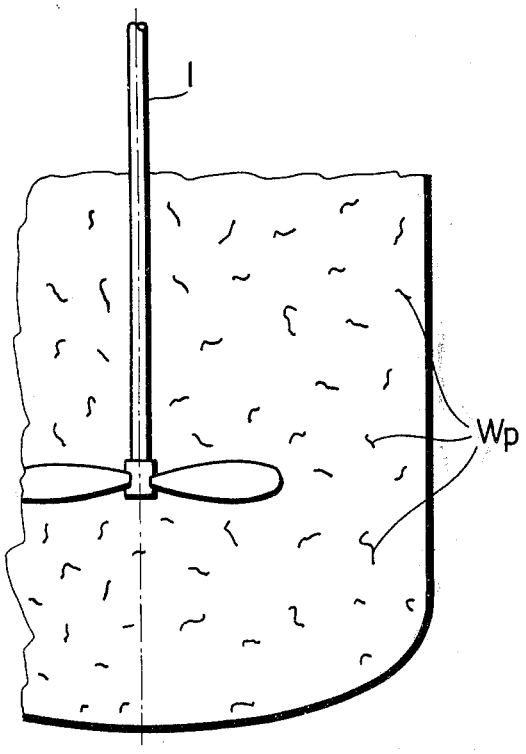
FIG. 4 is a somewhat schematic view of line-like agitators in combination with a rotor.

The agitator is a passive one when the point-like elements $P_p$ or the line-like elements $W_p$ do not introduce external energy, they can move, rotate or vibrate freely in the various phases, offering some resistance to the waves created by the known agitator I (FIGS. 2 and 4).

The passive point-agitator elements $P_p$ are from the aspect of the phases inert, solid, aniso-dimensional particles of homogeneous or heterogeneous dimensional distribution whose dimensions range from 1 to 2000 $\mu$m (FIG. 2).

Their main characteristics are: the so-called greatest diameter $d$, the number $sz$ of particles present in the space to be intensified, and the total length $\Sigma l$ of the agitator elements which is in case of homogeneous elements the imaginary sequence of a number $sz$ of elements of the dimension $q{:}\Sigma l = sz.\ q$.

The elements of the passive line-agitator $W_p$ (FIG. 4) are in respect to the material phases similarly inert, being constructed of a solid elastic material, expediently of a metal or plastics. They may be linear, wave-shaped, curved or twisted. Their main characteristics are: the "diameter" of the element $W_p$, its thickness $q$, the length $l$ of the element which may be identical or diverse, and the number $sz$ of the elements. Their main criterion is that the thickness $q$ of the elements ranges from 10 to 5000 $\mu$m, and the proportion of thickness to length ($q{:}l$) may vary between 1:5 and 1:100. One of their important characteristic is the total length of $\Sigma l$ (of the elements $W_p$) which is in case of elements of identical length the product of the length $l$ of the individual elements and the number $sz$ of the elements: $\Sigma l = sz.\ l$.

The number sz of the passive agitator elements may be so great that they fill up at least 0.01 % of the total volume of the phases, though it must not exceed the level at which the phases can be maintained still in a fluid state with the known or novel agitators I.

Figure 3:
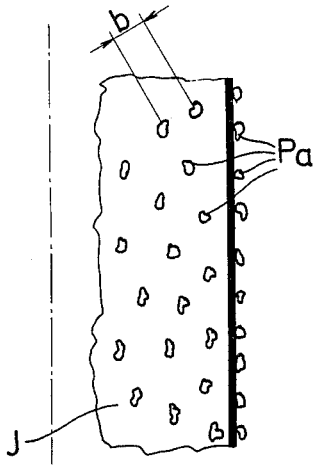
FIG. 3 is a somewhat schematic view of point-like agitators attached to a rotor.
Figure 5:
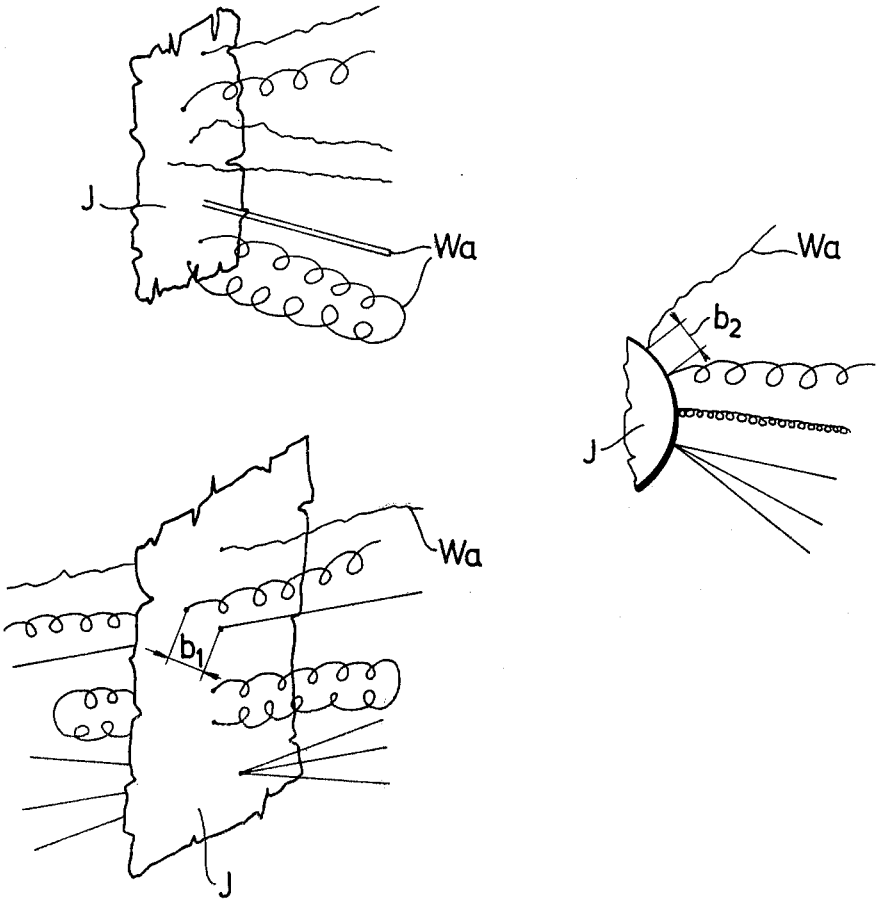
FIG. 5 is an enlarged fragmentary view of line-like agitators on their support structure.
Figure 6:
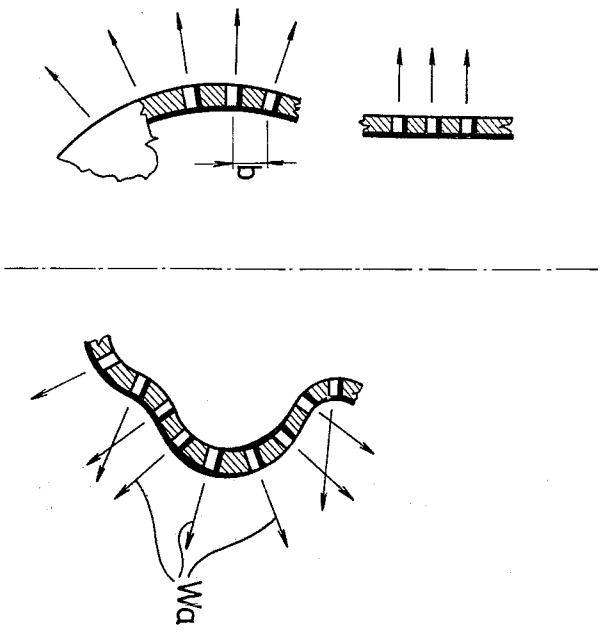
FIG. 6 is a somewhat schematic view of structure for introducing gas into a liquid as an aspect of the present invention.

Agitators are denoted as active when by means of them energy originating from an external source is introduced into the space to be intensified (FIGS. 3, 5 and 6). Such external energy may be mechanical energy.

The active agitator elements $P_a$, $W_a$ may be fixed to an agitator shaft end or ends or to some surface J which may be stationary or moving over the phases or in the phases in a linear, rotating or varying direction and curvature, with a continuous or vibrating motion which motion is maintained by an external energy source.

The main characteristic of agitators consisting of the active point-like elements $P_a$ and of the line-like elements $W_a$ is similarly the diameter q, the length $l$ of the element, the number sz of the elements and the total length of the agitator elements: $\Sigma l$.

At the active line-agitators $W_a$ (FIG. 5) where the ratio of the elements $q:l$ may vary from 1:10 to 1:15000, the elements $W_a$ are fixed at one point or several points to a surface J although they can freely deviate, move and vibrate. The elements $W_a$ that are inert in respect to the material phases are constructed of solid elastic materials expediently of a metal or plastics though they may consist also of a gas or liquid (FIG. 6).

Common characteristics of these novel agitators are further: the agitator surface F (the sum of the surface of the agitator elements P, W) and the agitator volume Q (the sum of the volumes of the elements P, W).

In comparison to the known agitator volumes the agitator volume Q is the ¼ to 1/10 part of the former while the agitator surface is at least off the same order of magnitude as the surface of known agitators but in most cases it exceeds their surface. Consequently, the surface per unit volume of the agitator, the specific surface F/Q is essentially greater (by an order of magnitude) than that of the known agitators whereas the agitator volume Q/F per unit volume of the agitator is essentially lower than that of the known agitators. This means at the same time that the mass of the agitator and the agitator mass per unit surface is of a lower order of magnitude. The differences become even more conspicuous on comparing the total length $\Sigma l$ of the agitator elements (the length of the shearing edges) in cases of the known agitators with those of the novel-type agitators P, W. The total length referred to unit volume and unit surface, respectively, of the agitator is about the tenfold to hundredfold value of that of conventional agitators. On examining the same total length per unit of the space to be intensified (total length density), the obtained value $\Sigma l/V$ will be the tenfold to thousandfold value of the data given for the known types of agitators.

In the course of great number of experiments with the novel point-agitators P and line agitators W according to the present invention we have found that the high specific surface and length density of the agitators are responsible for their capability of intensification.

We have found that the rate increase of the transport processes, the intensification of the dispersion is the more efficient the lower is the radius of curvature of the elements P, W, and the more the value of $q/2$ approaches the submicroscopic dimension, the greater is the specific agitator surface F/Q, the higher is the length density $\Sigma l/V$ of the agitator, and the longer is the path Z covered by the agitator elements P, W in the phases during unit time.

The path Z covered in unit time in the space to be intensified depends e.g. in case of a rotating active line-agitator $W_a$ on the diameter $d$ of the agitator (indirectly on the length $l$ of the line element W), the number sz of the line elements and the number of revolutions $n$ of the agitator: in that $Z = d \,.\, . \, sz \,.\, n$ .

According to what has been said above the intensifying effect of the agitators of novel type according to the invention, consisting of point-like elements P and line-like elements W can be attributed to the essential increase of the density of the impulse flow which latter is known to be the prerequisite of increasing the density of components flow and heat flow. This means that the effective density of mass flow is increased suddenly by these agitators.

On applying zero-dimensional point-agitators and one-dimensional line-agitators the specific surface of the phases increases, the turbulence increases, and the thickness of the border layer, of the so-called laminar sublayer decreases.

In the case of passive agitators the increases of turbulence is due to "secondary" turbulences created by $P_p$, $W_p$ agitator elements that are moving, rotating and vibrating freely in the phases when the isobar flow surface created e.g. by a known agitator, a propeller stirrer is augmented by the point-like elements $P_p$ and line-like elements $W_p$, and at the same time the border layer between the turbulent centres created by the stirrer (the laminary sublayer) is mechanically made thinner by a "secondary" turbulance created in this sublayer.

In the case of active agitators the turbulence increases owing to the high Re number created by the higher number of revolutions attained as a consequence of their relative mass decrease. At the same time, owing to the high length density of the agitator and the increase of the number of turbulent centres the laminar sublayer located between them becomes thinner and thinner due to the vibration of the agitator elements.

The great specific surface of the novel agitators according to the invention in achieved with a mass of relatively lower order of magnitude than that pertaining to the known agitators. In this way it is possible to attain a high number of revolutions (in a liquid a peripheral speed exceeding 30 m/s) without any self-oscillation of the agitator axle since the agitator is capable of balancing itself in that the agitator elements W, P arrange themselves according to the frictional conditions of the liquid.

We have examined the technical parameters of the preparation of an oil/water emulsion by means of an embodiment of the novel agitator according to the present invention, namely a rotating agitator containing line-elements $W_a$, and for the sake of comparison, also by means of a known agitator: the turbine stirrer. In the nine series of experiments conducted by us (three of which were experiments carried out with turbine stirrer and six were with line agitator), the parameters of the experiments were kept constant throughout in that a mixture of 100 ml of oil and 1000 ml of water (V = 1100 ml) was emulsified in a beaker of a diameter D = 130 mm. The diameters of both types of stirrer (d = 43 mm) were equal in seven series of experiments whereas in two series (No. 8 and 9) the diameter of the line agitator was $d = 80$ mm. The agitators were placed at a height of $h = 30$ mm from the bottom of the beaker. The same electromotor was used in all the experiments, its number of revolutions in neutral gear was $n = 4200$ li l/min. The height of the turbine blades was chosen so as to be equal to that (M = 8 mm) of the line elements $W_a$ at the surface generated by rotation of the stirrer axle.

The efficient stirring period of emulsification ($s$) was measured by a method described in the literature (J. BURGER: Magyar Kémikusok Lapja 10, 466 (1962) in that light was transmitted through the stirring vessel, and the changes of light intensity with time were measured. When no changes in light intensity were perceivable (the transmitted light remained stable), the period was considered as the time required for efficient stirring. Then the obtained oil/water emulsion was poured into a graduated cylinder and the time $t$ (min) required for the complete separation of the emulsion was measured.

During stirring, also the number of revolutions of the loaded stirrer $N_k - t$ was measured by means of a revolution counter.

The results of these comparative experiments are shown in Table 1 (the individual data of measurements are mean values of ten measurements each). The symbols used in this table are as follows:

$d$ : diameter (mm) of the agitator,
$sz$ : number of agitator elements (blade number, number of line elements),
F : surface (mm²) of the agitator,
Q : volume (mm³) of the agitator,
$n_k$ : number of revolutions (per min) of the loaded stirrer,
F : specific surface (mm²/mm³) of the agitator,
$\Sigma l$ : total length (mm) of the agitators,
$\Sigma l/V$: total length density of the agitator referred to unit of the stirred volume (mm/ml),
$\tau$: time $s$ required for efficient stirring, The length L of the blades, and, respectively, of the line elements $W_a$ were 14 mm in series 1–7 of the experiments and 32.5 mm in series 8 and 9. The "thickness" of the line elements $W_a$ was $q = 0.5$ mm, and the ratio of diameter to length $q:l$ was 1:28 in series of experiments 4 to 7 whereas it was 1:65 in series 8 and 9.

In respect to the series of experiments 1—3 it appears from Table 1 that the decrease of the numbers of revolution is 22–26 %. With the increase of the number of blades the stirring periods slightly decrease to very short periods, and the time required for the complete separation of the emulsion practically does not alter (12–14 minutes).

In the series of experiments 4 to 7 when line elements $W_a$ of an identical length $l$ were applied which were fixed at one point to the revolution surface J on the axle while their other ends moved freely, the number of revolution decreased only by 13–14 % at an unchanged value of D/$d$ while the time $\tau$ required for admixture was reduced by 50 % and at the same time the period required for separation $t$ increased to an 8-10-fold value.

Thus, under the same experimental conditions the efficiency-requirement of the novel line agitator $W_a$ is lower by about 30–40 %, the time required for the efficient stirring is reduced to half of the conventional value, and the emulsion remains stable for periods longer by 8–10 times. This may be expressed also in that the novel agitator $W_a$ disperses more efficiently with a lower amount of energy introduced, power is applied during a shorter period against surface tension; the utilization of energy is improved to a great extent, the amount of power utilizable technically increases in relation to the energy introduced in the system. In the series of experiments 8 and 9 when the length $l$ was kept stable and where the ratio of D/$d$ was 1:62 (a value not applied in the case of stirrers of such numbers of revolutions) the period of admixture $\rho$ could be reduced further, and the period $t$ required for the separation appreciably increased. On examining in Table 1 the parameters characteristic for the agitator elements and the tested agitator, respectively, it is striking that at an almost identical agitator surface F (series of experiments 1 and 6), the volume of the line agitator Q was greater only by slightly more than one third than the volume of the conventional turbine stirrer.

Table 1

| Series of experiment | Type of stirrer element | Experimental parameters d | D/d | $n_k$ | sz | F | Q | F/Q | /V | | | t |
|---|---|---|---|---|---|---|---|---|---|---|---|---|
| 1 | turbine | 43 | 3.02 | 3.300 | 2 | 252.0 | 176.4 | 1.428 | 28 | 0.0254 | 145 | 14 |
| 2 | " | 43 | 3.02 | 3.200 | 3 | 378.0 | 264.6 | 1.428 | 42 | 0.0508 | 141 | 14 |
| 3 | " | 43 | 3.02 | 3.100 | 4 | 504.0 | 352.8 | 1.428 | 56 | 0.0762 | 135 | 12 |
| 4 | line $W_a$ | 43 | 3.02 | 3.700 | 8 | 87.4 | 22.1 | 3.950 | 112 | 0.1010 | 80 | 97 |
| 5 | " | 43 | 3.02 | 3.700 | 16 | 174.8 | 44.2 | 3.950 | 224 | 0.2036 | 78 | 100 |
| 6 | " | 43 | 3.02 | 3.600 | 24 | 262.2 | 66.2 | 3.950 | 336 | 0.3054 | 74 | 105 |
| 7 | " | 43 | 3.02 | 3.600 | 40 | 437.0 | 110.5 | 3.950 | 560 | 0.5090 | 70 | 130 |
| 8 | " | 80 | 1.62 | 2.950 | 24 | 616.2 | 153.0 | 4.000 | 780 | 0.7090 | 65 | 210 |
| 9 | " | 80 | 1.62 | 2.900 | 40 | 1020.4 | 255.0 | 4.000 | 1300 | 1.1818 | 60 | 232 |

This is proved by the fact that whereas in case of the turbine stirrer the specific agitator surface (F/Q) is 1.428 this parameter is greater by more than 2.5 in case of the line agitator: 3.95. The difference is even more striking on comparing the length values ($\Sigma l$) of these two types of agitator elements. In case of the same agitator surface (series of experiments 1 and 6) the value of $\Sigma l$ rises to the 12-fold level in case of the same agitator volumes (series of experiments 1 and 8). The increased efficiency of the novel agitators can be explained by the ratio $\Sigma l/V$, the length density per unit volume of the emulsion: this is higher by ten to fifty than that of the known agitator types.

Subsequent to the above described series of experiments a great number of series of experiments in various directions have been conducted in order to clear up the possibilities of application of the novel type agitators in the field of intensification of various transport processes.

We investigated e.g. the intensifying effect of the novel agitator on the solvent extraction of liquids non-immiscible with each other (see Example 3).

We found that e.g. on extracting acetic acid dissolved in a higher alcohol with water at the same stirring period and number of revolutions, the amount of residual acetic acid retained in the organic phase with the use of the line agitator $W_a$ will be only 1/50 of the quantity retained in the case of propeller stirrer.

We investigated in our experiments the intensifying effect exerted on the dispersion of solid substances in liquids (see Example 2). Sodium bentonite was suspended in water using a propeller stirrer and then using the novel agitator $W_a$ (for the same stirring period, diameter and number of revolutions). Whereas sedimentation started about two hours after the termination of the suspension treatment with the propeller stirrer, in the suspension prepared with the novel agitator $W_a$ this process began only after a fortnight.

On applying the novel type agitators as stirrers not only the peripheral speed can be raised appreciably in relation to the known stirrers but even with a free choice of the ratio $D/d$ in the range from 1.2 to 3.5 also the distance $h$ of stirrer from the bottom of the device can be varied within relatively wide limits.

On using the stirrers applied in the series of experiments 2 and 8 mentioned in Table 1, 500 ml of oil was emulsified with 500 ml of water at a height $h = 65$ mm, nearly 75 % of the full height H! Whereas the turbine stirrer was practically inefficient under these conditions, on using the novel agitator $W_a$ we succeeded in producing by stirring for 90 seconds an emulsion whose complete separation required 170 minutes.

In case of the known types of stirrers, in addition to the above mentioned conditions, the agitator must protrude into the stirring space, into the interface of the two phases, in order to attain an efficient stirring. Much to our surprise we have found in case of the active agitators $W_a$ according to the present invention that the rotating line agitator is capable of conducting the dispersion process even when located over the stirring space (at a total height H of the phases). This means that this agitator is capable of transmitting the energy originating from external energy sources to the media to be dispersed, by the mediation of the "gas cushion" existing over the phases. Consequently, it is possible to eliminate contact with ay liquid phases that are corrosive to the agitator because also an inert gas can be a medium suitable for energy transfer.

A great number of experiments were carried out by us for testing the use of the novel zero-dimensional point-like agitators P or of the one-dimensional line-like agitators W according to the present invention, for the dispersion of solid substances in liquids, of liquids in liquids, of gases in liquids, of solid substances in gases, of liquids in gases, of solid substances and liquids in gases. It is impossible to describe all these experiments in this specification. However, we attempted to choose our examples in a way as to exhibit the wide possibilities of the application of our invention.

In the course of our further researches into the application of the novel agitators according to our invention, the continuous operation of heterogeneous chemical reactions was examined.

The saponification of vegetable oils with alkali hydroxides is known to be an endothermic process of long duration. Soapmaking is carried out in industrial practice for 5–6 hours at a temperature of 80°–100°C. In our experiments the vegetable oil and sodium hydroxide were emulsified in the conventional proportion at room temperature by the line agitator $W_a$. The fatty acid content of the reaction mixture decreased in two hours to 0.5 % by weight, i.e. the saponification process was terminated (see Example 10).

On repeating this experiment in a way such that the vegetable oil and the solution of sodium hydroxide were preheated to 60°C prior to their admixture, the fatty acid content of the reaction mixture decreased to below 0.5 % by weight within half an hour.

It is known (Hung. patent specification No. 146818, and Schwab, G. M.: Katalyse an flüssigen Metallen. Dechema Monographien 38, 205 (1960)) that heterogeneous organic chemical reactions in the gas phase can be carried out expediently by allowing the vapours of the reactants to bubble through a metal melt (e.g. the decarboxylation or oxidative decarboxylation of furfural, thermal decomposition of pentane with steam, production of paraffin hydrocarbons, cracking of hydrocarbons etc.). Since the specific heat of the metal melt is higher by three orders of magnitude than that of gases and vapours, the process can be carried out under isothermal conditions, and the bubbles of the vapours of the reaction mixture behave like elementary reactors. At the same time the embodiment of the process is made more difficult by the fact that the specific gravity of the vapours is lower by two orders of magnitude than that of the melt and thus they ascend and descend quickly, promoting the combination of the individual bubbles.

On using the novel agitators $W_a$ according to the present invention, the vapours of the reactants are dispersed in the melt of the metal or of a salt of the metal to such an extent that the sizes of the formed bubbles will be smaller by an order of magnitude, preventing thus the combination of bubbles. Moreover, owing to the high turbulence the melt will be mixed up more intensively. An intensive turbulence of the melt is of particular advantage in the case of a molton bath of metals and metal oxides when the metal oxide is inclined to form a film on the surface (e.g. lead oxide) that prevents the escape of the already converted vapours. On applying the line agitator $W_a$ the length of the operational period in the melt is reduced, the efficiency of the equipment is appreciably increased. Oxidation reactions in the vapour phase can be advantageously realized by means of two reactors each of which contains an active line agitator $W_a$ keeping the melt also between the reactors in a constant circulation. In one of the reactors a part of the metal present in the melt is oxidized to a defined degree by dispersing air in the melt. When this portion of the metal enters the second reactor it delivers oxygen for the oxidation of the reactant present in the vapour phase. Subsequently it returns to the first reactor where the melt is again partially oxidized etc. (e.g. the system lead-lead oxide).

The novel passive and active, zero-dimensional and one-dimensional, point-like and line-like agitators and their application will be elucidated in detail by the following non-limiting Examples.

EXAMPLE 1

A rotary line agitator is rotated at 2500 rpm in a cylindrical metal vessel of 2 litres volume. The diameter of the agitator is 330 mm, the length $l$ of the line elements $W_a$ is 125 mm, their number $sz = 3500$, their thickness $q = 0.8$ mm. The surface of revolution J to which one of the points of the line elements of steel is attached is equal to 8740 $cm^2$. The device is equipped with two pipe ends for feeding and one for removing the material. The materials are fed by the feeding pipe ends onto the agitator elements in a direction parallel to the axle of the rotary agitator. The removed material is introduced into a vessel of a volume of 10 l that contains 5 litres of water of a temperature of 5°C. Through one of the pipe ends for feeding 200 g of melted paraffin of a temperature of 90°C is fed whereas through the other pipe end 800 g of water of the same temperature is fed.

The formed paraffin/water emulsion flows from the vessel into the device containing cold water where the paraffin solidifies. On examining the paraffin suspension under the microscope it was found that the obtained suspension consists of particles of a grain size of 0.5–1.0 $\mu$m.

EXAMPLE 2

180 g of sodium bentonite and 3450 ml of water of a temperature of 60°C are transferred into a cylindrical device of a volume of 5 litres in which alternately a rotatory line agitator according to Example 1 and a propeller stirrer is placed each of which is operated at the same rpm of 5000. In both experiments the preparation of the suspension is conducted for the same period: ten minutes stirring with each of the propeller stirrer and the line agitator.

The two types of suspension prepared in this way were poured separately into glass cylinders and the rates of sedimentation observed. It was found that sedimentation started after two hours in the suspension prepared by the propeller stirrer and separation was completed in two days. In contrast to that, in the suspension prepared by means of the line agitator the sedimentation started only after two weeks.

EXAMPLE 3

The extraction with water of acetic acid from an organic solvent immiscible with water was examined.

A laboratory stirrer motor of 5000 rpm was applied, in the first experiment with a propeller stirrer of a diameter of 37 mm while in the second experiment with a rotary line agitator of the same diameter. The line elements $W_a$ had a length of 14 mm, a thickness of 0.2 mm and their number was 10000.

50 ml of a solution of n-octylalcohol containing 5.2 g/100 g of acetic acid and 50 ml of distilled water were transferred into a 250 ml beaker. The mixture was alternately stirred for one minute each with both types of stirrer, then the organic phase was separated from water and its residual acetic acid content was determined.

Results of ten consecutive measurements each averaged:

acetic acid content of n-octylalcohol prior to extraction 5.2 g/100 g acetic acid content after extraction carried out with propeller stirrer 0.548 g/100 g acetic acid content after extraction carried out with line agitator $W_a$ 0.110 g/100 g It can be seen from the data of the above experiments that the line agitator $W_a$ carried out the emulsification during the same operational period at an efficiency higher by 50.

EXAMPLE 4

Experiments were carried out in order to elucidate how gas absorption can be intensified by means of the line agitator.

On burning 2.25 g of elementary sulfur in excess air, the absorption of the formed 4.5 g of sulfur dioxide gas by water at room temperature was investigated. In one series of experiments the formed gas was allowed to bubble for five minutes through 800 ml of water whereas in another series of experiments a rotary line agitator of 190 mm diameter was rotated at 3000 rpm in a glass cylinder of 200 mm diameter. The total length of the 0.3 mm thick agitator elements $W_a$ was 50 mm and their number was 10000.

The top 800 ml of water was transferred over a period of 5 minutes onto the agitator elements, and within the same time the above stated amount of sulfur dioxide gas was introduced in counter-current into the glass cylinder.

In both series of experiments the contents of sulfurous acid were determined: with the bubbling method it was 1.39 g/800 ml but for the absorption with the line agitator 2.88 g/800 ml.

Thus, with the bubbling method 24.3 % of sulfur dioxide whereas with the absorption by means of the line agitator 50.1 % of it were absorbed.

EXAMPLE 5

On the basis of the results of our experiments carried out concerning gas absorption we examined the extent to which the air uptake of water can be raised. This is an important factor in the biological purification of sewage.

In these experiments a $W_a$ line agitator of 360 mm diameter with a horizontal axle, having 1650 line elements of 0.4 mm thickness and 145 mm length was used.

In a quiescent stage the agitator elements protruded below the surface of the water.

The temperature of the air was 20°C, its relative humidity 59 % whereas the temperature of water was adjusted to 35°C by thermostat.

When the agitator was kept in rotation it dispersed the water in the air as a spray. At a height of 130 mm above the water surface samples were withdrawn from the water spray at various distances (0.5, 0.8, 1.5 and 2.0 m) from the axle of the agitator, and the temperature and oxygen content of these samples was established.

Temperature of water at start: 35°C, its $O_2$ content 4.2 ml/l on treatment with the agitator:

at a distance of 0.5 m 30°C, its $O_2$ content 5.03 ml/l
at a distance of 0.8 m 27°C, its $O_2$ content 5.53 ml/l
at a distance of 1.5 m 24°C, its $O_2$ content 5.63 ml/l
at a distance of 2.0 m 21°C, its $O_2$ content 6.06 ml/l

EXAMPLE 6

In a cyclone-shaped device a $W_a$ line agitator of 330 mm diameter containing 4150 line elements $W_a$ of 125 mm element length and 0.8 mm element thickness was rotated at 2500 rpm.

Below the rotating agitator 5 $m^3$/min of air saturated with powdered cement was introduced. This air left the device at the upper part of the cyclone.

Parallel to the axle of the agitator one l/min of water was introduced concentrically.

On illuminating the air leaving the device no Tyndall effect was observable, indicating that the air contained no dust particles.

EXAMPLE 7

In a six meter high device with a closed top and with a conical bottom a rotary line agitator with a horizontal axle was placed and rotated at 2500 rpm.

The agitator contained $W_a$ line elements of steel of 330 mm diameter, 0.8 mm thickness and 125 mm length whose element density was 4 elements per $cm^2$ at the surface of revolution.

In a stirrer equipped with a Z-shaped stirrer clay was mixed up with powdered graphite. A graphite clay pulp with 21 % moisture content was obtained.

The pulp was introduced into the above described device in a horizontal direction by means of screw feeder in such a way that the pulp was pressed through a slit of 1 by 4 cm at a rate of 4 cm/s and then sprayed along the mantle of the rotating line agitator. Then air heated to 100°C was led into the device.

The sprayed pulp was dried over a five meter long path of sedimentation.

The graphitic clay powder removed from the device contained 0.3 % of moisture, its particles were of a size of 40–70 $\mu$m.

EXAMPLE 8

In a device shaped like that specified in Example 7 and whose conical part formed one third of the total height, a jacketed agitator with a central vertical axle is placed, then the agitator is kept in rotation at 2500 rpm, while cooling with water in the jacketed mantle.

The cylindrical perforated agitator of 100 $cm^3$ volume which is open at the top and has a mantle height of 4 cm, is equipped with bores of a diameter of 5 mm. In each second bore a $W_a$ line element of 1 mm thickness and 160 mm length is fixed. In each $cm^2$ of the surface of revolution of the agitator 4 line elements are located. Below the agitator, gas (nitrogen or oxygen) is led into the upper third part of the device.

Into the hollow body of revolution of the line agitator metallic cadmium of a temperature of 340°C is introduced as a melt and sprayed at a temperature of 450°C in a nitrogen current in one series and in an oxygen current in another series of experiments. When nitrogen current was applied, powdered metallic cadmium of a grain size below 1 $\mu$m was obtained in the conical part of the device equipped with water cooling.

On spraying in an oxygen current, in turn, upon varying the point of feeding the gas, powders containing cadmium and cadmium oxide in various proportions were obtained, depending on the length of the path of sedimentation. In the case of a sedimentation length of 1 m the obtained powdered cadmium contained 11.5 % of cadmium oxide. Powders with any desired proportion of metal to metal oxide produced in this way can be used for the preparation of electrodes for storage batteries.

EXAMPLE 9

It is known that the purity of the end product is appreciably affected by the degree of dispersity of the suspension formed upon the precipitation of reaction products in solid state during chemical reactions. Substances precipitated in solid state during the precipitation process may contain inclusions, and may be purified only by repeated washing or recrystallization. E.g. N-isopropyl-2-chloroacetanilide which is a liquid and precipitates i.e. solidifies only when led into cold water is produced according to the Hungarian Patent specification No. 159044 by allowing N-isopropyl aniline to react with monochloroacetic acid in the presence of phosphorus trichloride at a temperature of 80°–100°C. The substance introduced into cold water (of 5°–10°C) in a device equipped with the conventional turbine stirrer solidifies, and is subsequently washed four times with fresh water to obtain a product of a melting point of 68-72°C.

In a cylindrical device of 200 l volume and 560 mm diameter a rotary line agitator is placed. The surface of the hollow agitator cylinder of 100 mm diameter and 50 mm height was equipped with bores of 3 mm diameter: in 16 segments 4 bores each i.e. a total of 84 bores. Between these bores a total number of 2880 $W_a$ line elements of 100 mm length, of a steel wire of 0.4 mm thickness were fixed at one point of their length. The agitator was rotated at 3000 rpm at the surface of 150 litres of water of 5°C.

The liquid reaction products of a temperature of 90°C were introduced in a continuous stream into the hollow upper portion of the agitator. The precipitated N-isopropyl-2-chloroacetanilide was filtered and dried. The obtained fine crystalline product had (without any additional washing) a.m.p. of 76°–78°C.

EXAMPLE 10

In a cylindrical and at the bottom cone-shaped device of 250 mm height and 220 mm diameter a rotary agitator is rotated at 3500 rpm on a vertical axle. The agitator consisted of $W_a$ line elements of 0.5 mm thickness and 90 mm length. Onto these agitator elements 1000 g/min of edible oil and 532 ml/min of 7.0 N sodium hydroxide solution was led and the obtained fine emulsion (of an average grain size of 0.5–1.0 $\mu$m) removed at the bottom of the device.

In the first series of experiments both the oil and the alkali fed were at room temperature (25°C) whereas in the second series of experiments both materials were introduced preheated to 60°C and fed hot into the device. From the emulsions obtained in this way samples were withdrawn at 15 minute intervals, and their contents of free oleic acid i.e. the unsaponified part determined by analytical procedure.

In the case of the emulsion prepared at room temperature the content of free oleic acid diminished to below 0.5 g in two hours while in the case of the emulsion prepared at 60° C this was attained in half an hour and the saponification was ended.

EXAMPLE 11

To 500 ml of dodecylbenzene in a 2000 ml beaker 250 ml of fuming sulfuric acid (oleum with 8 % content of free sulfur trioxide) was added in 15 minutes. The reaction mixture was stirred with a laboratory-type four-blade stirrer at 5000 rpm. Then the obtained dodecylbenzene sulfonic acid was converted into the sodium salt with the use of sodium hydroxide, and the product subjected to analysis.

| | |
|---|---|
| The conversion was | 43.3 % |
| yield: | 41.2 % |
| dry matter content: | 48.2 % |
| active detergent content: | 24.3 % |

On repeating the experiment, $P_p$ point agitator elements of silica of individually 0.5 $mm^3$ volume and with a total volume of 300 ml were placed in the dodecylbenzene, and the oleum was introduced in only one minute with the use of the same stirrer. On separating the $P_p$ point elements by filtering, the obtained dodecylbenzene sulfonic acid was similarly converted into the sodium salt, and the product subjected to analysis.

| | |
|---|---|
| The conversion was | 65.3 % |
| yield: | 54.2 % |
| dry matter content: | 65.3 % |
| active detergent content: | 45.6 % |

EXAMPLE 12

In a device of 220 mm upper diameter and 800 mm height with a cone-shaped bottom part a cylinder of 200 mm diameter and 11 mm wall thickness was rotated. On the 250 mm high mantle of this cylinder 2 bores of 0.1 mm diameter each were provided in each $cm^2$. The cylinder was rotated at 2500 rpm around a hollow axle.

Into the device 1230 ml/min of dodecylbenzene sulfonic acid whereas into the rotated cylinder gaseous ammonia of an overpressure of 20 atm were introduced at a feeding rate of 7140 ml/min. The gas left the device through the bore in the cylinder wall as a gaseous $W_a$ line agitator. From the bottom of the equipment 1600 ml/min of ammonium dodecylbenzenesulfonate was removed.

The thermal decomposition of benzyl homologues in an aqueous medium by bubbling through a bed of melted lead is known from the Hungarian Patent Specification No. 146818.

A reactor of 95 mm diameter equipped with electric heating contains 41.7 kg of melted lead, of a volume of 3674 $cm^3$ and a surface of 61.2 $cm^2$. A mixture of gasolene vapours and steam is led below the surface of the lead melt: evaporating 60 ml/h of gasolene and 60 ml/h of water. The temperature of the melt was 700°C.

The amount of the formed gas was 50 litres/h, its calorific value 9776 kcal/$m^3$ and its composition: 0.1 % nitrogen, 12.5 % hydrogen, 48.0 % methane, 0.4 % oxygen, 15.6 % carbon monoxide, 1.6 % carbon dioxide and 21.8 % unsaturated lower hydrocarbons.

The same process was then carried out in equipment consisting of two cylindrical vessels, an upper part of 95 mm diameter and a lower part of 250 mm diameter attached to the upper one. In the lower part of greater diameter of the equipment there was a rotating agitator of 200 mm diameter, 2 mm thickness and 80 mm length containing 700 $W_a$ line elements under which agitator the mixture of steam and gasolene vapours was introduced. The agitator was rotated at 2500 rpm.

On feeding a mixture obtained by the evaporation of 850 ml/h of gasolene and 850 ml/h of water, we obtained from the equipment through the lead melt of a temperature of 700°C an amount of 700 litres/h of a gas mixture of a calorific value of 11785 kcal/$m^3$.

The composition of this gas mixture was: 1.0 % nitrogen, 0.7 % hydrogen, 46.3 % methane, 0.6 % oxygen, 6.8 % carbon monoxide, 2.2 % carbon dioxide and 34.4 % of unsaturated lower hydrocarbons.

EXAMPLE 13

Similarly to the process specified in Example 12, conversion into furane was carried out on feeding furfural, air and steam into a device where the mixture was allowed to bubble through a bed of melted lead and with the use of a rotatory line agitator, respectively. The bed of melted lead was in both cases of a temperature of 320°C.

Feeding rates during the bubbling procedure were: 70 ml/h of furfural, 75 ml/h of air and 20 ml/h of water. The furane yield was 50 ml/h.

In the experiment with the $W_a$ line agitator the feeding rates were: 700 ml/h of furfural, 750 ml/h of air and 200 ml/h of water. The furane yield was 500 ml/h.

The amount of the applied melted lead was the same in all the experiments described in Examples 12 and 13.

What we claim is:

1. An agitator for the intensification of fluid-fluid transport processes, comprising a rotor having thereon a multiplicity of filamentary elements, the elements having a thickness-to-length ratio of 1:5 to 1:5000 and a thickness of 10–5000 $\mu$m, there being several thousand said elements on the rotor.

2. A method for intensifying transport processes, comprising establishing plural immiscible fluids in contact with each other, and rotating in contact with said immiscible fluids a rotor having thereon filamentary elements whose thickness is 10–5000 $\mu$m and whose thickness-to-length ratio is 1:5 to 1:5000, said elements turning at a peripheral speed of at least 30 m/s, there being several thousand said elements and said rotor turning at several thousand revolutions per minute.

3. A method as claimed in claim 2, and including in said fluids a multiplicity of solid particles of a size of 1–1000 $\mu$m.

* * * * *